US006609788B2

(12) United States Patent
Hatasa et al.

(10) Patent No.: US 6,609,788 B2
(45) Date of Patent: Aug. 26, 2003

(54) LIQUID CONTAINER CARTRIDGE, LIQUID CONTAINER AND RECORDING APPARATUS

(75) Inventors: Nobuyuki Hatasa, Kanagawa-ken (JP); Hideo Fukazawa, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/822,214

(22) Filed: Apr. 2, 2001

(65) Prior Publication Data

US 2001/0033315 A1 Oct. 25, 2001

(30) Foreign Application Priority Data

Mar. 31, 2000 (JP) ..... 2000/097622

(51) Int. Cl.[7] ..... B41J 2/175
(52) U.S. Cl. ..... 347/86
(58) Field of Search ..... 347/85, 86, 87, 347/19, 49

(56) References Cited

U.S. PATENT DOCUMENTS

| | | | | | |
|---|---|---|---|---|---|
| 5,138,344 | A | * | 8/1992 | Ujita | 347/86 |
| 5,500,664 | A | * | 3/1996 | Suzuki et al. | 347/86 |
| 5,805,187 | A | * | 9/1998 | Sasaki | 347/86 |
| 5,956,057 | A | * | 9/1999 | Childers et al. | 347/49 |
| 6,003,984 | A | * | 12/1999 | Bohorquez et al. | 347/86 |
| 6,065,824 | A | * | 5/2000 | Bullock et al. | 347/19 |
| 6,132,036 | A | * | 10/2000 | Abe et al. | 347/86 |
| 6,390,601 | B1 | * | 5/2002 | Morita et al. | 347/49 |

FOREIGN PATENT DOCUMENTS

| | | |
|---|---|---|
| EP | 791463 | 8/1997 |

OTHER PUBLICATIONS

U.S. patent application No. 09/654,702, filed Sep. 1, 2000.
U.S. patent application No. 09/822,213, filed Apr. 2, 2001.

* cited by examiner

*Primary Examiner*—Anh T. N. Vo
(74) *Attorney, Agent, or Firm*—Fitzpatrick, Cella, Harper & Scinto

(57) ABSTRACT

A liquid container cartridge for containing liquid which is detachably mountable to a main assembly of a recording apparatus for effecting recording by depositing the liquid onto a recording material, the liquid container cartridge includes a connecting portion for establishing a supply path for fluid communication with the main assembly of the recording apparatus when the liquid container cartridge is mounted to the main assembly of the recording apparatus; a first member; and a second member united with the first member; a claw provided on a surface of one of the first and second members; a tubular member which is provided on a surface or the other of the first and second members and which is engaged with the claw when the first and second members are united with each other; a projection provided on a surface of one of the first and second members; and a recess which is provided on a surface of the other of the first and second members and which is engaged with the claw when the first and second members are united with each other.

20 Claims, 8 Drawing Sheets

LIQUID CONTAINER CARTRIDGE, LIQUID CONTAINER AND RECORDING APPARATUS

FIELD OF THE INVENTION AND RELATED ART

The present invention relates to a liquid container, in particular, a liquid container with a large capacity, which is removably mountable in the main assembly of a recording apparatus, and stores liquid (ink) used for recording by a recording apparatus. The present invention also relates to a recording apparatus in which such a liquid container. in particular, a liquid container with a large capacity, is removably mountable.

Conventionally, a recording apparatus records on recording medium such as paper, fabric, plastic sheet, OHP sheet, and the like. It employs one of various recording heads different in the recording system they employ. As for the types of recording heads mounted in a recording apparatus, there are various recording heads different in the recording methods they use. For example, there are a wire-dot recording method, a thermal recording method, a thermal transfer method, and an ink jet method. Among various recording apparatuses, those that employ an ink jet recording system have been commercialized and have been used as an outputting means of an information processing system, for example, a printer as an output terminal of a copying machine, a facsimile machine, an electric typewriter, a word processor, or a work station, or a handy printer, that is, a portable printer, with which a personal computer, a host computer, a disk apparatus, a video apparatus, and the like, are provided.

In an ink jet system, an ink jet head is provided with microscopic ejection holes, and ink is shot out, in the form of an ink droplet, from these microscopic ejection holes. A desired recording is made by causing a plurality of ink droplets to land on the recording medium. An ink jet head for an ink jet recording apparatus employs one of various means for generating energy for ejecting ink from an ejection orifice, for example, a means which employs electromechanical transducers such as a piezoelectric element, or a means which ejects ink droplets by the effect of the heat generated by irradiating electromagnetic waves such a laser beam upon ink.

In recent years, a great amount of progress has been made in the field of a computer and the software therefore. As a result, it has become possible to process a color image, and therefore, a recording apparatus capable of outputting a high quality image, that is, a highly precise image, is in high demand as an output terminal for a computer capable of processing a color image. In order to enable an ink jet recording apparatus to output a color image, a plurality of inks different in color are used. Further, ejection hole density is increased, and ink density is changed.

With the drastic improvement in ink and a recording head, an ink jet recording apparatus has been improved in terms of durability (fastness) and water resistance of an image recorded by the apparatus, the recording speed, along with the reliability. As a result, an ink jet recording apparatus, which had remained in a small market for the users who use the apparatus at home or in a small office, has begun to penetrate into a large market for business users who use the apparatus in an office on a large scale. In comparison to a personal user, a business user has greater printing frequency and print count, and also is more sensitive to the cost of running the apparatus.

FIGS. 10 and 11 show an example of a conventional replaceable ink cartridge (liquid container) used with the above described ink jet recording apparatus. FIG. 10 is an exploded perspective view of this ink cartridge, and shows component structures FIG. 11 is a sectional view of the ink cartridge illustrated in FIG. 10.

As shown in FIGS. 10 and 11, this ink cartridge has an ink storage chamber formed by an ink container 541 and an ink container lid 542. It also has a waste ink storage chamber formed by a waste ink container lid 545. Within the waste ink container 543, an absorbent member 544 for absorbing and retaining the recovered ink (the shape of the absorbent member 544 in the drawing represents the shape of the absorbent member 544 after its installation into the waste ink container 543) is contained. The lid 542 is attached to the ink container 541 by supersonic welding. It is also by supersonic welding that the waste ink container 543 and its lid 545 are attached to each other.

The ink container 541 is provided with a plurality of tubular claw grippers 555, which are located on the external surface of one of the lateral walls of the ink container 541, and the waste ink container 543 is provided with a plurality of claws 554, which are located on the external surfaces of one of the lateral walls of the waste ink container 543. Thus, as the ink container 541 and waste ink container 543 are slid against each other, while keeping the lateral wall surface with claws 555 and the lateral wall surface with tubular claw grippers flatly in contact with each other, the claws 554 engage into the tubular claw grippers 555, securing the ink container 541 and waste ink container 543 to each other.

As the ink container 541 and the waste ink container 543 are joined with each other, the external surface of the lid 542 and the external surface of the lid 543 become level with each other. These two surfaces are each provided with a housing 550 which contains an ink path. Each housing 550 is filled with a dorm-shaped elastic member 556, and is capped with a crown 547 or a fixing member. These components make up the joint portion through which the ink storage chamber is connected to the apparatus main assembly to allow ink to flow between the ink storage chamber and the apparatus main assembly. This joint portion and its adjacencies are surrounded by a wall 553 provided for preventing a hand or the like from coming in contact with them. The height of the joint portion is approximately the same as, or less than, that of the wall 553.

The external surface of one of the lateral walls 553 of the ink cartridge is provided with a plurality of insertion error prevention grooves 551 for preventing an ink cartridge different in type from the standard cartridge for the recording apparatus from being inserted into the apparatus main assembly.

As described above, the ink jet recording apparatus market has expanded from the size of the personal user market to the much greater size of the business user market. In comparison to a personal user, a business user has greater printing frequency and print count, and also is more sensitive to the cost of running the apparatus. Thus, it is important to reduce ink cartridge exchange frequency, and also to reduce the running cost by reducing the ratio of the ink cartridge cost exclusive of the cost of the ink within the ink cartridge, relative to the cost of the ink within the ink cartridge, in order to meet the needs of the business users. As a result, an ink cartridge with a larger ink capacity has come to be widely used.

As an ink cartridge is increased in its ink capacity, the overall weight of the ink cartridge increases. Therefore, the impact to which the ink cartridge is subjected if a user accidentally drops the ink cartridge increases. In the case of an ink cartridge with a small ink capacity, even if the claws and tubular claw grippers of the ink cartridge were subjected to the impact caused by dropping, there was no problem. However, in the case of an ink cartridge with an increased ink capacity, the impact to which the claws 554 and tubular claw grippers 555 are subjected is much greater, creating a possibility that the ink container 541 and waste ink container 543 become separated due to the impact. Further, in the case of an ink cartridge which has a large capacity and is structured as was the above described conventional ink cartridge, if it is subjected to the impact which applies to the waste ink container 543 from the direction of the lid 545, a relatively large force applies to the claws 552 and tubular claw grippers 553 in the direction to disengage them, making it probable that the ink container 541 and waste ink container 541 become separated from each other.

Further, with the increase in the usage of an ink jet recording apparatus, inks which are suitable for specific usages have been developed, increasing the number of inks available for an ink jet recording apparatus. Obviously, inks different in properties must not be mixed, and therefore, in order to prevent inks different in properties from being mixed, it is necessary to increase the number of identification mechanisms, such as the insertion error prevention grooves of the above described conventional ink cartridge, which are different in configuration. In order to increase the number of identification mechanisms different in configuration, it is necessary to increase the number of the structural elements for an identification mechanism. However, it is difficult to secure a physical space for placing an identification mechanism comprising a large number of structural elements.

SUMMARY OF THE INVENTION

Thus, the primary object of the present invention is to provide an ink cartridge (liquid container) which is superior in terms of resistance to the impact caused by dropping, and the identification mechanism of which can be easily modified.

A liquid container (container cartridge) in accordance with the present invention, which accomplishes the above described object, is a liquid container for holding liquid, which is removably mountable in the main assembly of a recording apparatus which records an image by adhering liquid to recording medium. It has a joint portion which forms a liquid path between the liquid container and the recording apparatus main assembly as the liquid container is mounted into the recording apparatus main assembly.

A liquid container (container cartridge) in accordance with the present invention is characterized in that it comprises two major portions secured to each other. One of the two major portions is provided with claws which are located on the surface to be placed in contact with the other of the two major portions, whereas the other major component is provided with tubular claw grippers which are located on the surface to be placed in contact with the first major portion as the two major portions are joined, the claws engage into the tubular claw grippers, being gripped thereby to secure the two portions to each other. Further, one of the two major portions is provided with a projection which is located on the surface different from the surface on which the claws or tubular claw grippers are located, and the other of the two major portions is provided with a recess, which is located on the surface correspondent to the surface with the projection, and in which the projection is fitted. As the two major portions are joined, the projection is perfectly fitted in the recess.

with the provision of the above described structural arrangement, even if the liquid container is accidentally dropped, and the interface between the two major portions is subjected to stress, the projection remains perfectly fitted in the recess, controlling the shifting of the two major portions relative to each other at their interface. Therefore, the stress which applies to the claws and tubular claw grippers is reduced, preventing the claws and tubular claw grippers from becoming disengaged, or damaged. Since the projection and recess are much stronger against impact, compared to the claws and tubular claw grippers, there is little possibility that they will be damaged by the stress and their engagement with each other will become unstable due to the damage, According to the present invention, the ink container is provided with at least two pairs of a claw and a tubular claw gripper, and in addition, the ink container is structured so that the direction in which a group of claws are moved to be gripped by the correspondent tubular claw grippers, becomes perpendicular to the direction in which another group of claws are moved to be gripped by the correspondent tubular claw grippers. Thus, the aforementioned two major portions of the ink container are secured to each other by at least two pairs of a claw and a tubular claw gripper, which are different in the direction in which they function. In other words, the movements of the two major portions relative to each other are controlled in two directions perpendicular to each other. Therefore, the two major components remain securely attached to each other.

Of the claws of the ink container, those which engage with the tubular claw grippers when the two major portions are moved relative to each other in the first direction, are made elastically deformable. Therefore, when sliding the two major portions to join them, the elastically deformable claws are first engaged in the tubular claw grippers, being kept deformed in the tubular claw grippers during the initial period, and then, the rest of the claws are engaged in the corresponding tubular claw grippers by continuing the sliding. In other words, according to the present invention, the two major portions of the ink container can be easily joined.

The aforementioned two major portions of the ink container are a liquid container main assembly, and a cover attached to the liquid container main assembly. The liquid container main assembly forms a liquid storage chamber for holding liquid. The cover is provided with a plurality of guide rails or guide grooves, which slide one for one into a plurality of guide grooves or guide rails provided on the recording apparatus main assembly side, when the liquid container is inserted into the recording apparatus main assembly. Therefore, it is assured that, when the ink container is inserted into the recording apparatus main assembly, the liquid container is guided to the liquid container space where it is supposed to be mounted.

Further, the cover may be provided with an insertion error prevention projection which fits in an insertion error prevention recess provided on the recording apparatus main assembly side. In this case, the patterns of the projection and corresponding recess are varied according to the type of a liquid container. With this structural arrangement, when an attempt is accidentally made to insert an ink container into a recording apparatus into which this ink container is not supposed to be inserted, it cannot be inserted, and therefore, the ink container is prevented from being inserted into a recording apparatus incompatible with the ink container.

Further, the cover may be provided with a storage medium, and terminals for electrically connecting the storage medium with the main assembly of a recording apparatus, while providing the recording apparatus main assembly with a means for reading the data in the storage medium of the recording apparatus main assembly, and a recording apparatus operation controlling means for controlling the operation of the recording apparatus according to these data. With the provision of the above arrangement, the data regarding the detected state of the liquid container, the control data, the identification data, the liquid amount data, and apparatus maker data, can be stored in the storage medium, and based on these data, it is possible to generate a warning signal, to display recording data, and to interrupt a recording operation; in other words, it is possible to improve a recording apparatus in reliability. Further, the recording apparatus main assembly may be provided with a means for modifying the data in the storage medium, so that the data in the storage medium can be corrected as necessary to improve the data in the storage medium in reliability.

Further, the cover may be provided with a handle so that a liquid container can be mounted into, or removed from, the main apparatus of a recording apparatus by grasping the handle.

In essence, according to the present invention, the cover of an ink container is provided with: a plurality of guide rails or guide grooves, which can be slid into the guide grooves, one for one, provided on the main assembly side of a recording apparatus when the ink container is inserted into the recording apparatus main assembly; an insertion error prevention recess or insertion error prevention projection, the configuration of which can be varied according to liquid container type; a storage medium; and/or a handle, making it possible to realize various types of ink containers different in the configuration of the recording apparatus into which they are mounted, simply by modifying the cover configuration while keeping the same configuration for the ink container main assembly. Further, the ink container is structured so that ink does not come into contact with the cover, and therefore, liquid resistant material has to be used only for the liquid container main assembly. In other words, the liquid container main assembly and its cover can be formed of different materials, according to their functions, in order to reduce material cost, or to improve their functions.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described in detail with reference to the appended drawings.

Figure 1:
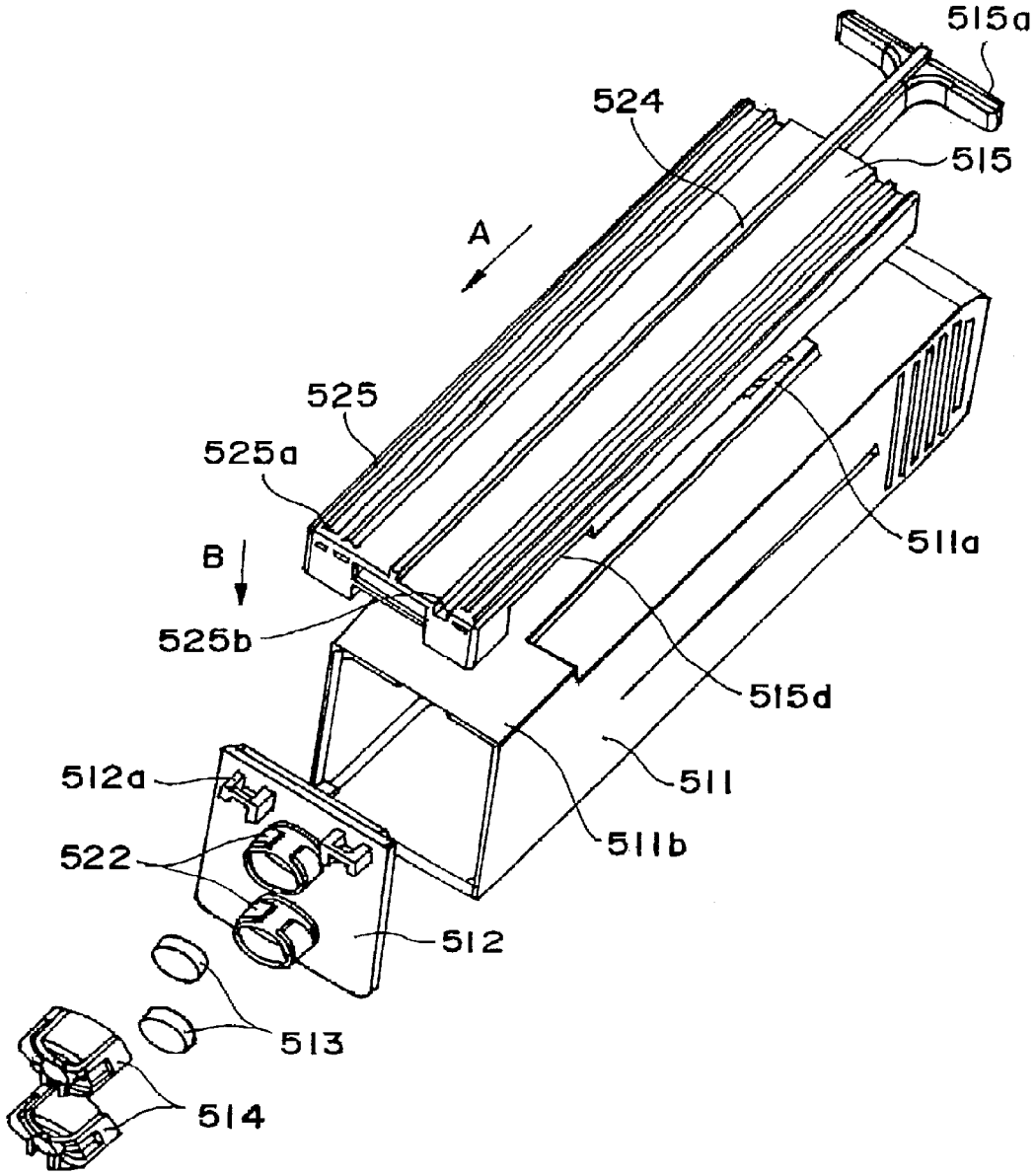
FIG. 1 is an exploded perspective view of the ink cartridge in the first embodiment of the present invention.
Figure 2:
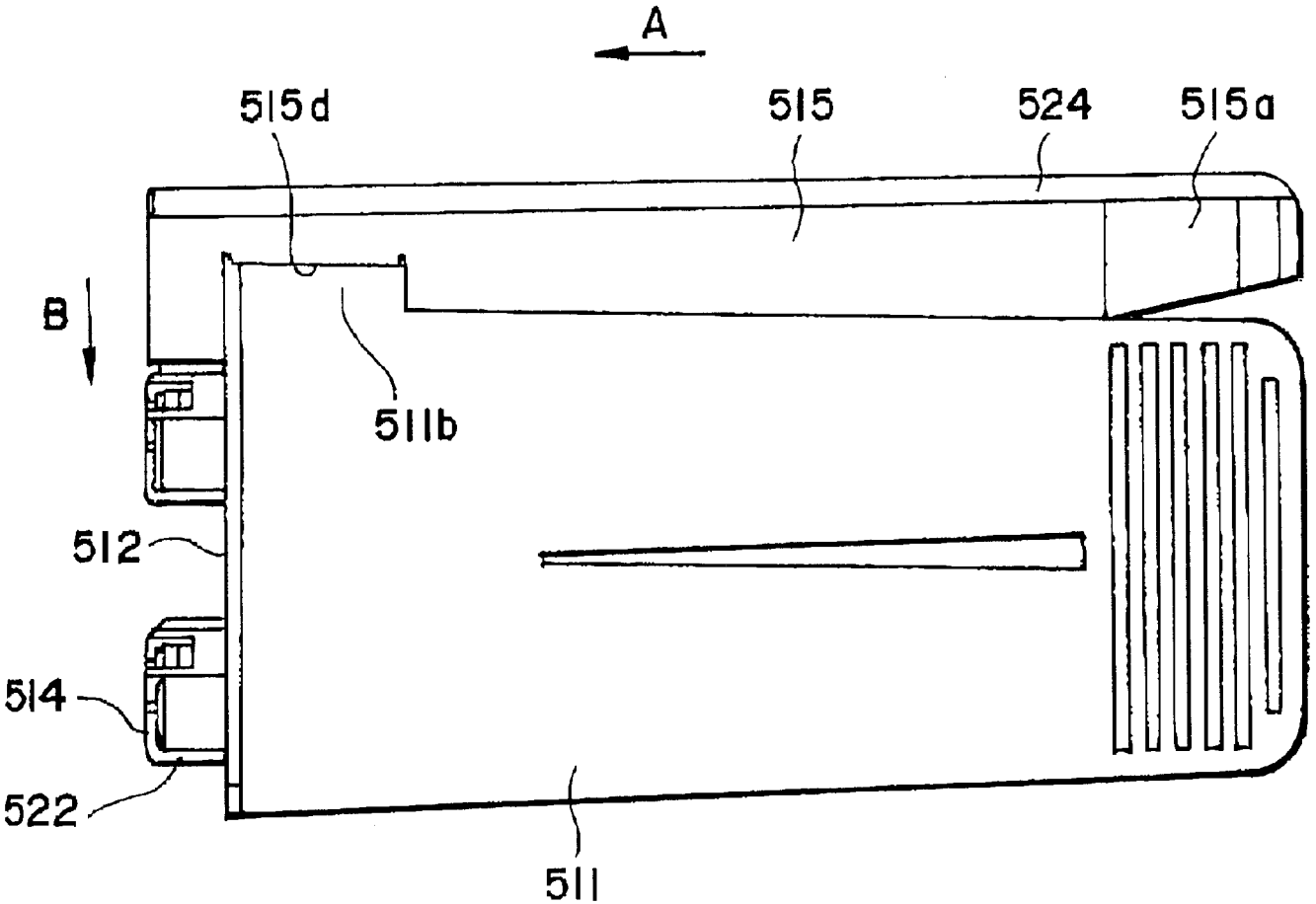
FIG. 2 is a side view of the ink cartridge illustrated in FIG. 1.
Figure 3:
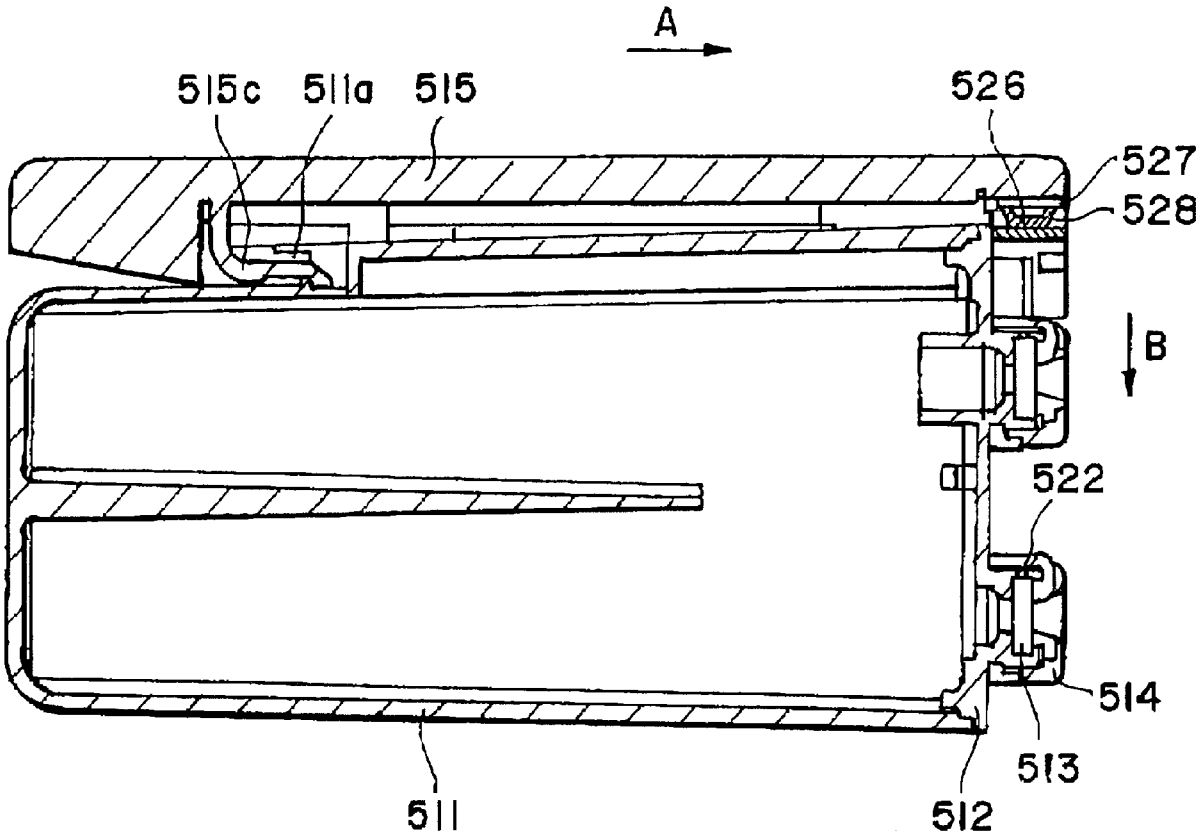
FIG. 3 is a sectional view of the ink cartridge illustrated in FIG. 1, at a plane perpendicular to the longitudinal direction of the ink cartridge.
Figure 4:
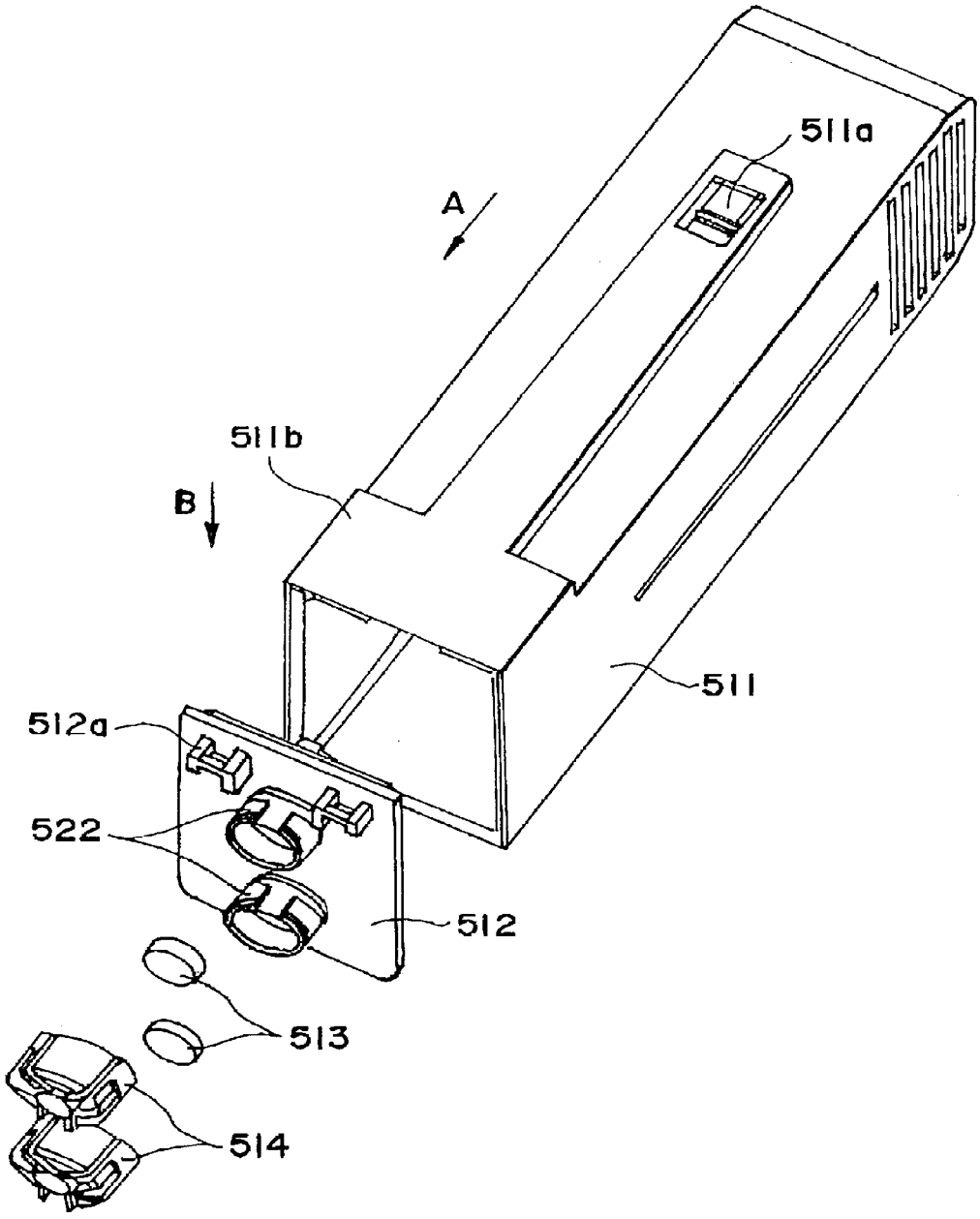
FIG. 4 is an exploded perspective view of the ink container 511 of the ink cartridge illustrated in FIG. 1.
Figure 5:
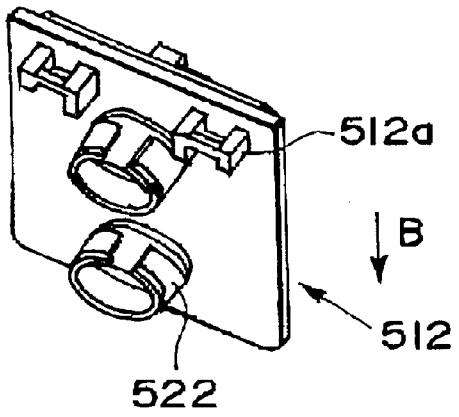
FIG. 5 is a perspective view of the lid 512 of the ink cartridge illustrated in FIG. 1.
Figure 6:
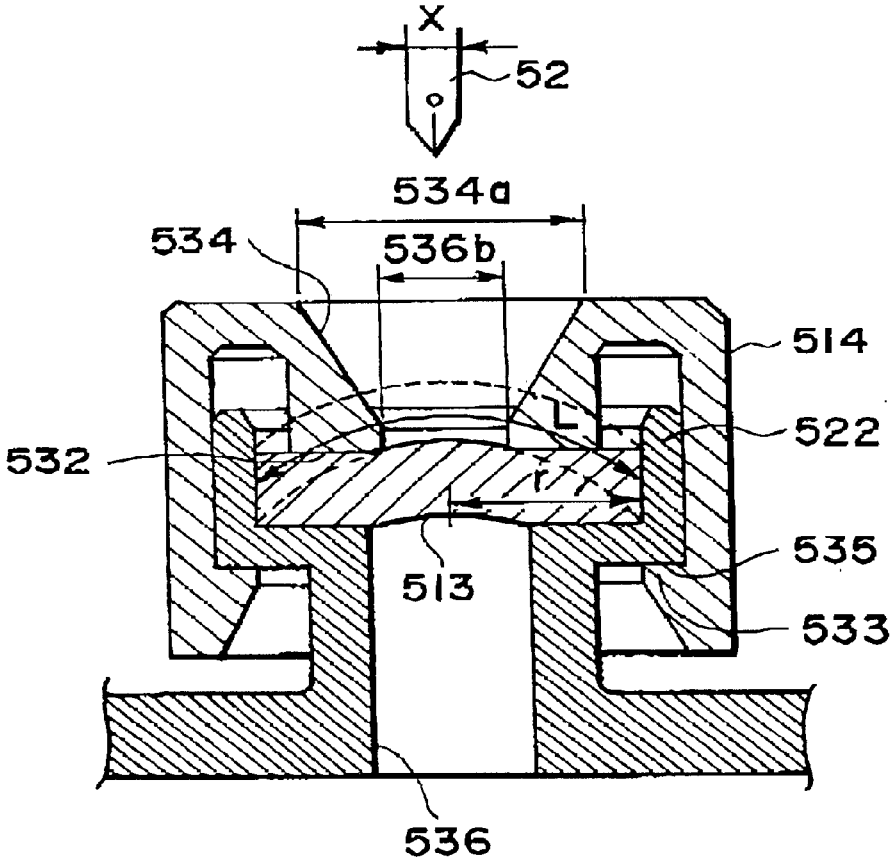
FIG. 6 is an enlarged sectional view of the joint portion of the ink container 511.
Figure 7:
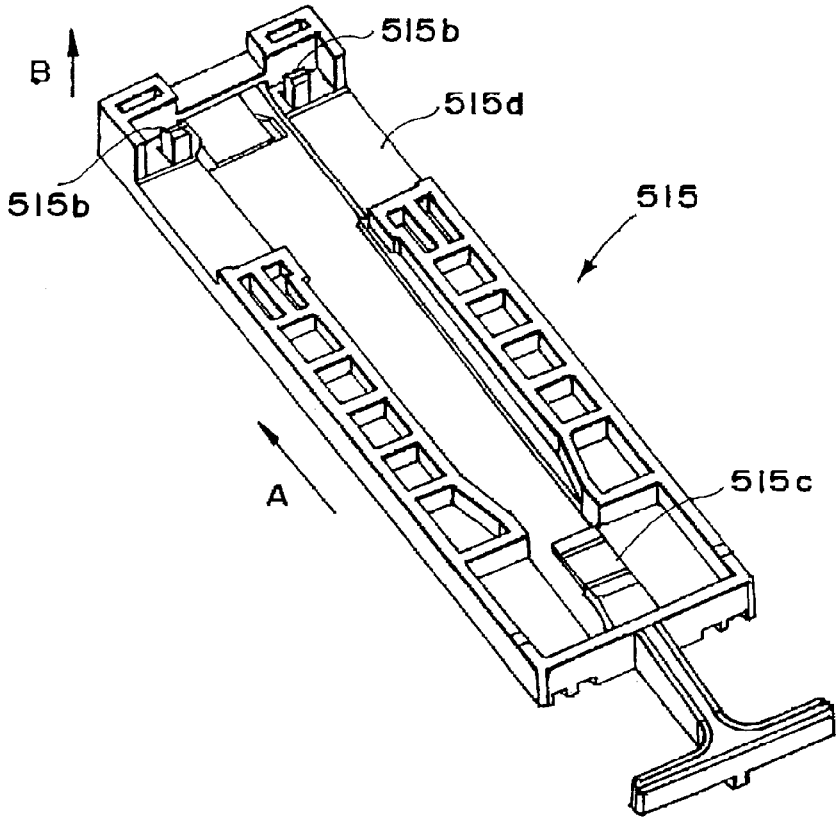
FIG. 7 is a perspective view of the cover 515 of the ink cartridge illustrated in FIG. 1.
Figure 8:
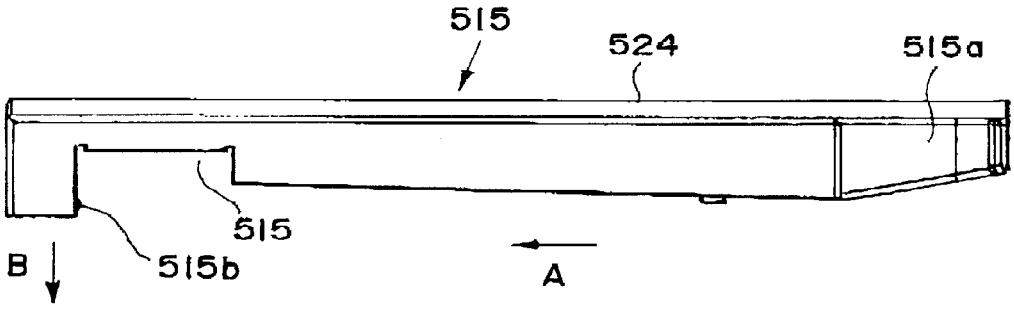
FIG. 8 is a side view of the cover 515 illustrated in FIG. 7.

FIGS. 1–8 are schematic drawings of the ink cartridge (liquid container) in the first embodiment of the present invention. FIG. 1 is an exploded perspective view, and FIG. 2 is a side view. FIG. 3 is a sectional view at a plane perpendicular to the longitudinal direction of the ink cartridge, and FIG. 4 is an exploded perspective view of the ink container 511 of the ink cartridge illustrated in FIGS. 1–3. FIG. 5 is a perspective view of the lid 512, and FIG. 6 is an enlarged sectional view of the joint portion of the ink container 511. FIGS. 7 and 8 are drawings of the cover 515 of the ink cartridge illustrated in FIGS. 1–3; FIG. 7 is a perspective view, and FIG. 8 is a side view.

As shown in FIGS. 1–3, this ink cartridge comprises a main structure which has an ink storing chamber. The main structure comprises an ink container 511 and a lid 512. The ink container 511 and its lid 512 are welded to each other by ultrasonic welding. The lid 512 of the ink container 511 is provided with two housings 522, which contain through holes and are located on the external surface of the lid 512. Within each housing 522, a dome-shaped elastic member 513 is positioned. Each housing 522 is capped with a crown 514 as a fixing member. In other words, the housings 522, elastic members 513, and crown 514 make up the ink cartridge joint, which is connected to its counterpart on the ink jet recording apparatus main assembly side.

As shown in detail in FIG. 6, the crown 514 has pawls 533 and pressing portions 532. Each pawl engages with its counterpart on the housing side, and each pressing portion 532 presses on the elastic member 513 in the direction approximately perpendicular to the diameter direction of the elastic member 513. Further, the crown 514 has an opening 534 for guiding the needle 52 on the main assembly side The opening 534 is shaped like a funnel, its leading end in terms of the cartridge mounting direction being greater in size than its trailing end. Thus, when the ink cartridge is mounted, the ink cartridge is guided by the interaction between the wall of the hole 534 and the needle on the main assembly side in such a manner that the approximate center portion of the top surface of the elastic member 513 aligns with the tip of the needle to prevent the needle entry point from deviating. Each housing 522 also has a cylindrical hole 536 which leads to the interior of the ink container.

Prior to the mounting of the crown 514, the elastic member 513 has a size outlined by a dotted line in FIG. 6. However, when the crown 514 is mounted, the elastic member 513 is pressed by the pressing portions 532 of the crown 514 in the direction approximately perpendicular to the diameter direction of the elastic member 513, being therefore deformed. Therefore, after the mounting of the crown 514, the elastic member 513 fits in the housing 522 as outlined by the solid line in the drawing Prior to the pressing of the elastic member 513 by the pressing portion 532 of the crown 514, the dimension L of the elastic member 513 in terms of the direction parallel to the direction of the sectional plane of FIG. 6 is greater than the internal diameter 2*r* of the housing 522; r<L. After having been pressed into the crown 514, the elastic member 513 remains compressed in the diameter direction of the housing 522. With the elastic member 513 remaining in this state, even if the needle 52 having penetrated the elastic member 513 is pulled out of the elastic member 513, the hole created through the elastic member 513 by the needle 52 is immediately closed by the resiliency of the elastic member 513, which has been increased by the compression. Thus, even if the ink cartridge is mounted or dismounted, the content, or ink, of the ink cartridge does not ooze out through the elastic member 513.

Further, this ink cartridge is provided with a cover 515 which has a plurality of grooves 525 for preventing an insertion error. These insertion error prevention grooves are parts of an identification mechanism. More specifically, the cover 515 is provided with grooves 525*a,* the leading end of each of which is blocked, and grooves 525*b,* the leading end of each of which is not blocked. Further, the recording apparatus main assembly side is provided with a plurality of rails which match the structures of the grooves 525*a* and 525*b,* respectively. Thus, the combination among the grooves 525*a* and 525*b* can be varied depending on the type of ink stored in each ink cartridge, to prevent the ink cartridge from being Inserted into an ink cartridge slot into which it is not supposed to be inserted In addition, the cover 515 is provided with a storage medium 526 (in this embodiment, EEPROM) for storing the data regarding the detected state of the recording apparatus main assembly and liquid container, control data, identification data, liquid volume data, and maker data. The storage medium 526 is connected to a terminal 527 for making connection between the storage medium 526 and the ink jet recording apparatus main assembly. The contact point between the storage medium 526 and terminal 527 is covered with a sealer, being thereby protected by the sealer 528.

Figure 9:
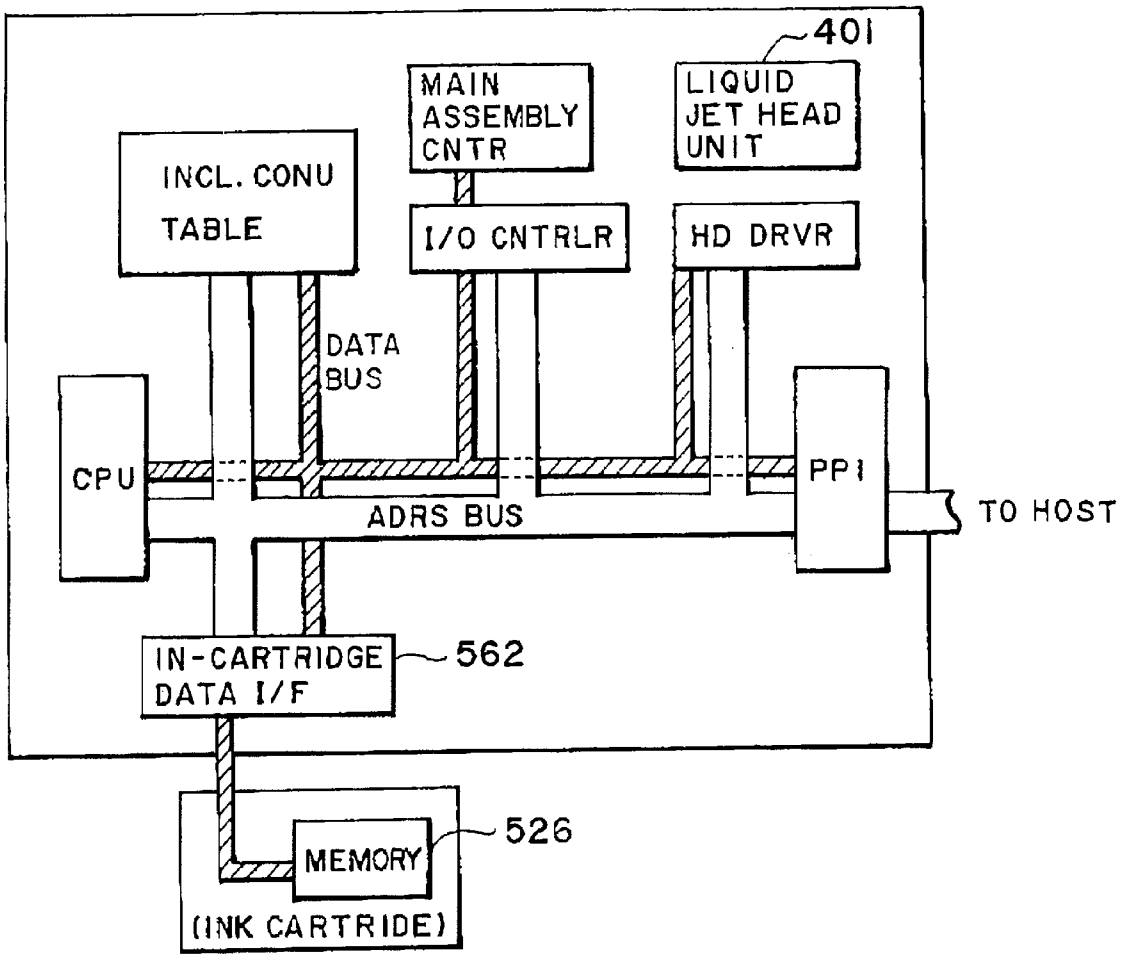
FIG. 9 is a block diagram for showing how the storage medium 526 of the ink cartridge illustrated in FIG. 1 is connected to the main assembly of a recording apparatus.
Figure 10:
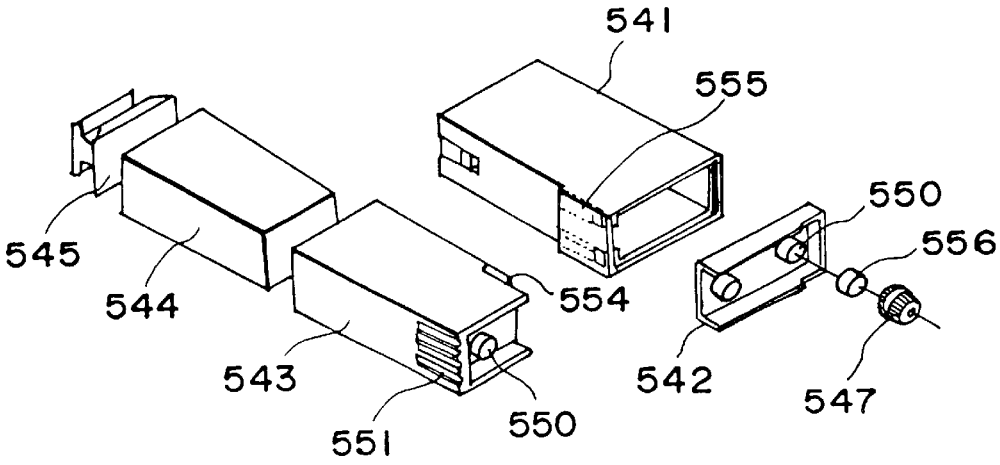
FIG. 10 PRIOR ART
FIG. 10 is an exploded perspective view of a conventional ink cartridge.
Figure 11:
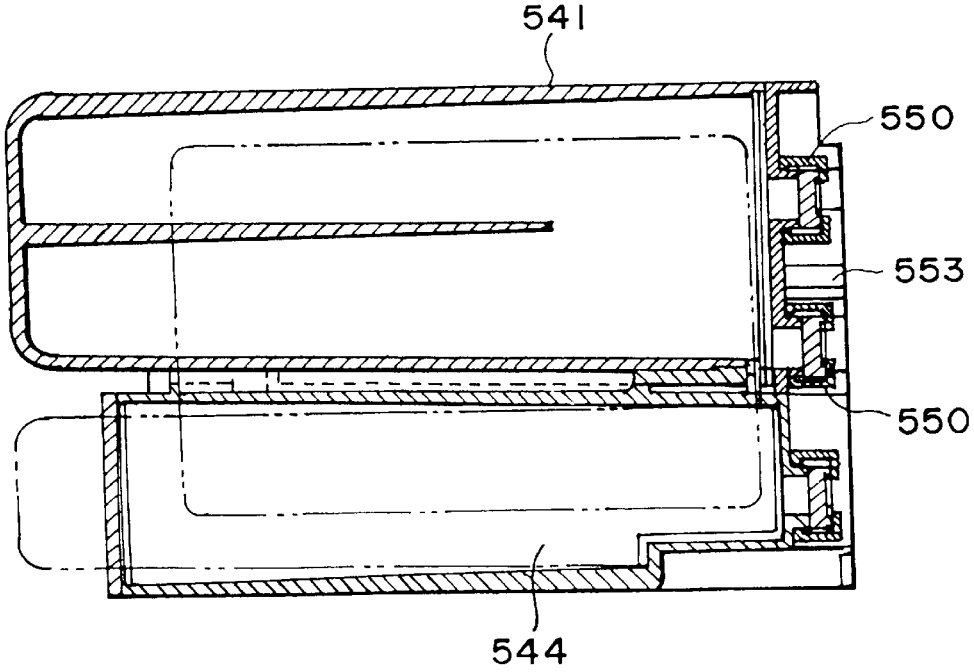
FIG. 11 PRIOR ART
FIG. 11 is a sectional view of the ink cartridge illustrated in FIG. 10, at a plane perpendicular to the longitudinal direction of the ink cartridge.

FIG. 9 is a block diagram for showing how the storage medium 526 is connected to the ink jet recording apparatus main assembly. As the ink cartridge is mounted into the apparatus main assembly, the storage medium 526 of the ink cartridge becomes connected to an interface 562 on the apparatus main assembly side, allowing the data in the storage medium 526 to be transmitted to the apparatus main assembly side. As a result, it becomes possible for the data having been stored in the storage medium 526 to be used for controlling the apparatus main assembly side, for example, for controlling the manner in which the recording head 401 is driven.

The cover 515 is provided with a guide rail 524 which guides the ink cartridge when the ink cartridge is inserted into the apparatus main assembly. More specifically, when inserting the ink cartridge into the apparatus main assembly, the guide rail 524 is inserted into a guiding groove on the apparatus main assembly side to correctly position the ink cartridge relative to the apparatus main assembly in order to assure that the joint portion of the ink cartridge is properly connected with the joint portion of the apparatus main assembly. Further, the cover 515 is provided with a handle 515*a* to be used when the ink cartridge is mounted into the recording apparatus, or the like occasions.

As described before, the ink cartridge (liquid container cartridge) in this embodiment comprises two member: the liquid container main assembly, which is made up of the ink container 11 and its lid 512, and the cover 515. Referring to FIG. 7, the cover 515, or one of the two members, is provided with claws 515*b* and 515*c*. The ink container 511 of the liquid container main assembly, or the other of the two members, is provided with a tubular claw gripper 511*a*, and the lid 512, which is a part of the liquid container main assembly, is provided with tubular claw grippers 512*a*. Thus, when assembling the ink cartridge, first, the lid 512 is solidly fixed to the ink container 511, and then, the cover 515 is slid on the liquid container main assembly in such a manner that the claws 515*b* of the cover 515 engage with the tubular claw grippers 512*a* of the lid 512, and the claw 515*c* of the cover 515 engages with the tubular claw gripper 511*a* of the ink container 511. As a result, the cover 515 engages with the tubular claw gripper 511*a* of the ink container 511. As a result, the cover 515 is secured to the liquid container main assembly (combination of ink container 511 and lid 512). Incidentally, the direction in which the cover 515 is slid is indicated by an arrow mark A. The portion of the wall of the ink container 511, which is placed in contact with the cover 515, is provided with a projection 511*b*, that is, such a structure that is larger than the tubular claw grippers 511*a* and 512*a*, and the claws 515*b* and 515*c*, whereas the portion of the wall of the cover 515, which is placed in contact with the ink container 511, is provided with a recess 515*d* in which the projection 511*b* can be inserted. Thus, after the joining of the cover 515, ink container 511, and lid 512, the projection 511*b* of the ink container 511 is perfectly fitted in the recess 515*d* of the cover 515.

When the projection 511*b* of the ink container 511 is located on the surface which comes into contact with the cover 515 as in this embodiment, the leading end of the cover 515 in terms of the direction in which the cover 515 is slid on the liquid container main assembly to be joined with the ink container 511, collides with the projection 511*b* of the ink container 511, preventing the cover 515 from being slid further. In order to prevent this problem, the cover 515 must be slid in the arrow A direction in such a manner that the leading end of the cover 511 is enabled to ride over the projection 511*b*. While the cover 515 is slid in such a manner, the cover 515 remains tilted relative to the liquid container main assembly, and the claws 515*c* remain in contact with the liquid container main assembly. Then, as the cover 515 is further slid, the leading end of the cover 515 moves past the projection 511*b,* and the claw 515*c* fits into the tubular claw gripper 511*a,* allowing the leading end of the cover 515 to drop in such a manner that the recess 515*d* of the cover 515 fits over the projection 511*b* of the ink container 511 and that the leading end of the cover 515 presses upon the lid 512. As a result, the cover 515 becomes horizontal and fits over the top portion of the liquid container main assembly In the above described joining sequence, the claw 515*c* is required to be temporarily deformable during the sliding of the cover 515, and regain its original shape after it fits in the tubular claw gripper 511*a*. Thus, the claw 515*c* is desired to be structured to make it L-shaped, or U-shaped, in cross section to provide it with flexibility. It the claw 515*c* is not flexible, it may be difficult to smoothly slide the cover 515, or the claw 515*c* may break as it fits into the tubular claw gripper 511*a*.

The claws 515*b,* and the tubular claw grippers 512*a,* or the counterparts of the claws 515*b,* are desired to be structured so that, as the cover 515 is moved in the direction to make the recess 515*d* of the cover 511 perfectly fit over the projection 511*b* of the ink container 511, the claws 515*b* fit into the tubular claw grippers 51*a* one for one in the direction indicated by an arrow mark B, that is, the direction approximately perpendicular to the interface between the cover 515 and ink container 511 (direction perpendicular to the cover sliding direction A). With the provision of the above described structure in which the direction B, in which the claw 515*b* is fitted into the tubular claw grippers 512*a,* and the direction A, in which the claw 515*c* is fitted into the tubular claw gripper 511*a,* virtually perpendicularly intersect with each other, and the cover 515 is secured to the ink container main assembly from two different directions, by the plurality of claws different in the direction in which they secure the cover 515 to the ink container. Thus, the movements of the cover 515 and liquid container main assembly relative to each other are controlled in two directions, assuring that the cover 515 and liquid container main assembly remain firmly secured to each other.

As is evident from the above description, the cover 515 of the ink cartridge in this embodiment extends beyond the plane of the external surface of the lid 512 fixed to the ink container 511, in other words, it projects beyond the other portions of the ink cartridge. Therefore, even if the ink cartridge is accidentally dropped to the floor or the like, it is most likely that the cover 515 will hit the floor or the like first, being subjected to the impact. As the cover 515 takes the impact, stress is created at the interfaces between the cover 515 and liquid container main assembly, and between the cover 515 and lid 512, in the directions parallel to their interfaces. However, the cover 515 and liquid container main assembly are secured to each other with the projection 511*b* perfectly fitted in the recess 515*d,* being therefore prevented from moving relative to each other. Thus, the claws 515*b* and 515*c,* and tubular claw grippers 511*a* and 512*a* are subjected to virtually no stress. The projection 511*b* and recess 515*d* are relatively large structural masses, and therefore, even if they happened to be subjected to relatively large stress, they are capable of absorbing the stress, preventing the claws 515*b* and 515*c* and tubular claw grippers 511*a* and 512*a,* which are holding together the liquid container main assembly (combination of ink container 511 and lid 512) and cover 515, from becoming disengaged or breaking. Thus, it is not likely that the cover 515 will become separated from the liquid container main assembly due to the disengagement of the claws from the tubular claw grippers, or due to their breakage.

In recent years, it is socially required to collect and recycle waste articles. Generally, polypropylene, polyethylene, and the like, are easy to recycle. However, these materials are generally low in resistance to the impact caused by dropping. Further, it is difficult to obtain such material that is uniform in ingredient, by recycling. Therefore, there is a possibility that as an ink container produced using recycled material comes into contact with ink, some ingredients of the ink container wall will dissolve into the ink, changing the ink properties, which may results in serious printing failure. In comparison, the cover 515 of the ink cartridge in this embodiment does not come into contact with ink, making it unnecessary to take into consideration the effects of ink upon the cover material and the effect of the cover material upon ink. In other words, according to this embodiment, the cover 515 can be formed using materials recycled from waste articles. Further, when producing ink cartridges with a large capacity, it is possible to select material superior in resistance to impact caused by dropping, as the material for the cover 515

Also in this embodiment, four insertion error prevention grooves 525 for preventing the erroneous ink cartridge insertion were provided. Such a situation that it is necessary to differentiate a greater number of ink cartridges than a number of ink cartridges which can be differentiated with the provision of four insertion error prevention grooves 525, can be dealt with by altering the intervals, widths, and/or shapes, of the insertion error prevention grooves 525, or by increasing the number of the insertion error prevention grooves 525. In other words, according to the present invention, it is possible to provide an ink cartridge with an identification mechanism, which can be simply modified by modifying only the cover 515 to produce ink cartridges for ink of new types, therefore making it possible to reduce to a relatively smaller amount the cost necessary for developing ink cartridges for ink of new types.

As described above, according to the present invention, a liquid container is essentially made up of two major components independent from each other, and the joint portion of one of the two components is provided with a plurality of claws and a projection, whereas the joint portion of the other of the two components is provided with a plurality of tubular claw grippers and a recess. The projection and recess are greater in size than the claws and tubular claw grippers, and the two major components are secured to each other, with the projection perfectly fitted in the recess. Thus, even if the liquid container is accidentally dropped, the two major components are prevented by the combination of the projection and recess from becoming displaced from each other, and therefore, the stress which applies to the claws and tubular claw grippers is reduced. Therefore, even if the liquid container is accidentally dropped, the claws and tubular claw grippers are prevented from becoming disengaged from each other, or are prevented from breaking. In other words, the present invention makes it possible to provide a liquid container which is superior in terms of resistance to impact caused by dropping Further, one of the aforementioned major components is made in the form of a cover with an identification mechanism. Therefore, the number of ink containers different in identification mechanism can be easily increased by modifying only the cover structure. In other words, all that is necessary when the structure of the identification mechanism of a liquid container must be modified to make the liquid container unusable with another recording apparatus different in main assembly, is to modify only the cover and place the modified cover upon an unmodified ink container main assembly. Thus, as far as a liquid container main assembly is concerned, a common production facility can be used for producing ink cartridges different in the ink to container therein. Further, when developing a new type of liquid container, the identification mechanism portion of a liquid container does not need to be taken into consideration, simplifying the development, and therefore, reducing cost in development and production. Thus, according to the present invention, it is possible to provide a liquid container with a low cost.

While the invention has been described with reference to the structures disclosed herein, it is not confined to the details set forth, and this application is intended to cover such modifications or changes as may come within the purposes of the improvements or the scope of the following claims.

What is claimed is:

1. A liquid container for containing liquid which is detachably mountable to a main assembly of a recording apparatus for effecting recording by depositing the liquid onto a recording material, said liquid container comprising:

a container body for containing the liquid;

a connecting portion, provided on a first side of said container body, for establishing a supply path for fluid communication with the main assembly of the recording apparatus when said liquid container is mounted to the main assembly of the recording apparatus;

a covering member connected with said container body at a side of said container body;

a first pair of locking portions, one of which is provided on said first side of said container body, and the other of which is provided on a corresponding side of said covering member, respectively, said first pair of locking portions being locked with each other;

a second pair of locking portions, one of which is provided on a second side, facing in the direction perpendicular to said first side, of said container body, and the other of which is provided on a corresponding side of said covering member, respectively, said second pair of locking portions being locked with each other; and a recess and a projection, one of which is provided in or on said second side of said container body, and the other of which is provided in or on the corresponding side of said covering member, respectively, said recess and projection being engaged with each other, and said recess and projection being disposed at said second pair of locking portions.

2. A liquid container according to claim 1, wherein said first pair of locking portions are engaged with each other by relative movement therebetween in an engaging direction which is parallel with the first side, and said second pair of locking portions are engaged with each other by relative movement therebetween in a direction crossing with the engaging direction.

3. A liquid container according to claim 2, wherein when said first pair of locking portions are brought into engagement with each other, said recess and projection are not engageable with each other, and when said first pair of locking portions are completely engaged with each other, said recess and projection are engageable with each other to permit said second pair of locking portions to engage with each other.

4. A liquid container according to claim 1, further comprising a guiding rail or groove engageable with a guiding groove or rail provided in the main assembly.

5. A liquid container according to claim 1, further comprising an indexing projection or recess at a position determined depending on a color of the liquid contained in said liquid container, said indexing projection or recess being engageable with a recess or projection provided in the main assembly.

6. A liquid container according to claim 1, wherein said covering member is provided with an information storing medium, and an electrical contact for establishing electrical connection between said information storing medium and the main assembly.

7. A liquid container according to claim 1, wherein said covering member is provided with a grip.

8. A liquid container according to claim 1, wherein said covering member and said container body are made of materials which are different from each other.

9. A liquid jet recording apparatus comprising a liquid container as defined in any one of claims 1–8, and a mounting portion for mounting said liquid container.

10. A recording apparatus to which a liquid container as defined in claim 4 is mountable, said apparatus comprising said guiding groove or guiding rail provided in the main assembly.

11. A recording apparatus to which a liquid container as defined in claim 5 is mountable, said apparatus comprising the indexing recess or projection provided in the main assembly.

12. A recording apparatus to which a liquid container as defined in claim 6 is mountable, said apparatus comprising means for reading information stored in said information storing medium and recording apparatus operation control means for controlling the apparatus in accordance with the information.

13. A recording apparatus to which a liquid container as defined in claim 12 is mountable, said apparatus comprising means for changing the information stored in said information storing medium.

14. A liquid container for containing liquid which is detachably mountable to a main assembly of a recording apparatus for effecting recording by depositing the liquid onto a recording material, said liquid container comprising:

a container body for containing the liquid;

a connecting portion, provided on a first side of said container body, for establishing a supply path for fluid communication with the main assembly of the recording apparatus when said liquid container is mounted to the main assembly of the recording apparatus;

a covering member connected with said container body at a side of said container body;

a first pair of locking portions, one of which is provided on said first side of said container body, and the other of which is provided on a corresponding side of said covering member, respectively, said first pair of locking portions being locked with each other;

a second pair of locking portions, one of which is provided on a second side, facing in the direction perpendicular to said first side, of said container body, and the other of which is provided on a corresponding side of said covering member, respectively, said second pair of locking portions being locked with each other, wherein said first pair of locking portions are engaged with each other by relative movement therebetween in an engaging direction which is parallel with said first side of said container body, and said second pair of locking portions are engaged with each other by relative movement therebetween in a direction crossing with the engaging direction.

15. A liquid container according to claim 14, further comprising a recess and a projection, one of which is provided in or on said second side of said container body, and the other of which is provided in or on the corresponding side of said covering member, respectively, said recess and projection being engaged with each other, wherein when said second pair of locking portions are brought into engagement with each other, said recess and projection are not engageable with each other, and when said second pair locking portions are completely engaged with each other, said recess and projection are engageable with each other to permit said first pair of locking portions to engage with each other.

16. A liquid container according to claim 14, further comprising a guiding rail or groove engageable with a guiding groove or rail provided in the main assembly.

17. A liquid container according to claim 14, further comprising an indexing projection or recess at a position determined depending on a color of the liquid contained in said liquid container, said indexing projection or recess being engageable with a recess or projection provided in the main assembly.

18. A liquid container according to claim 14, wherein said covering member is provided with an information storing medium, and an electrical contact for establishing electrical connection between said information storing medium and the main assembly.

19. A liquid container according to claim 14, wherein said covering member is provided with a grip.

20. A liquid container according to claim 14, wherein said covering member and said container body are made of materials which are different from each other.

* * * * *